US005158288A

United States Patent [19]

Chen et al.

[11] Patent Number: 5,158,288

[45] Date of Patent: Oct. 27, 1992

[54] TENNIS RACKET FRAME WITH MULTIPLE CROSS-SECTIONAL SHAPES

[75] Inventors: Ling-Huei Chen; Dar-Ming Chiang, both of Pan-Chiao City, Taiwan

[73] Assignee: Industrial Technology Research Institute, Taiwan, China

[21] Appl. No.: 564,874

[22] Filed: Aug. 9, 1990

[51] Int. Cl.[5] ..... A63B 49/02

[52] U.S. Cl. ..... 273/73 R

[58] Field of Search ..... 273/67 R, 73 R, 73 C, 273/73 D

[56] References Cited

U.S. PATENT DOCUMENTS

Re. 31,419 10/1983 Frolow ..... 273/73 C

FOREIGN PATENT DOCUMENTS 76316 3/1973 Taiwan .
77890 6/1974 Taiwan .
74410 8/1974 Taiwan .
77472 5/1975 Taiwan .
16413 12/1891 United Kingdom ..... 273/73 D

*Primary Examiner*—William H. Grieb
*Attorney, Agent, or Firm*—Scully, Scott, Murphy & Presser

[57] ABSTRACT

A tennis racket having a frame with the cross section thereof constituted by a plurality of different shapes, including at least triangles and ellipses. The frame is constituted by three sections, of which the first is connected to the shaft of the racket via a base section and has an elliptical cross section so as to provide a more rigid percussion region and thus better control over tennis balls, the second is next to the tip of the frame and has a triangular cross section which is capable of supporting greater top and lateral forces resulting from contact with external objects, and the third is disposed between the first and second and has an intermediate shape that changes gradually from the ellipse of the elliptical section to the triangle of the triangular section so as to provide a connection and continuity between the two.

5 Claims, 9 Drawing Sheets

TENNIS RACKET FRAME WITH MULTIPLE CROSS-SECTIONAL SHAPES

FIELD OF THE INVENTION

The invention relates generally to a tennis racket and in particular to a tennis racket of which the frame is constituted by a plurality of segments having different cross-sectional shapes, including at least triangles and ellipses, so as to improve the frame.

The improvements include:

(1) increasing the rigidity of the percussion region so as to maintain the shape of the frame when the racket is hitting a tennis ball, and thus provide a better control over the ball; and (2) increasing the strength of the frame around its tip so as to reduce the possibility of damage to the frame due to hitting the ground; this also reduces the stress around the tip of the frame when the frame hits ground.

BACKGROUND OF THE INVENTION

Tennis has been one of the most favorite sports in the world. This is due at least partly to improvements in the rackets. Sports equipment manufacturers and tennis players have spent their time improving rackets for decades, such as Taiwanese Patent Nos. 74,410, 76,316, 77,472 and 77,890. These are just a few examples. These disclosures, however, are not related to improvements concerning the cross section of a tennis racket frame. To the best of the applicant's knowledge, there have been no major changes under modifications of the cross section of tennis racket frames heretofore. Conventionally, a racket frame has a substantially rectangular cross section, as shown in FIG. 15, which is a cross-sectional view taken along line 15—15 of FIG. 14 wherein a conventional racket is shown. The cross section is uniform throughout the whole frame (see FIG. 16). The rectangular cross section, however, has the following disadvantages:

1. In accordance with analysis, the major factor that affects the characteristic of a racket is the cross-sectional shape thereof, because it determines, at least partly, the bending rigidity of the racket frame. (The bending rigidity is the area moment of inertia, which is determined by the cross-sectional shape times Young's modulus of the material that the frame is made of.) Further, there are two major external loads that will act upon the frame. One is the impact force resulting from hitting a tennis ball; this force is substantially perpendicular to the plane of the racket head. The other major load is the tensile of the strings and/or impact force resulting from a sudden contact of the frame tip with the ground during play; these forces are generally parallel with the plane of the racket head. Accordingly, the frame should have a structure that is capable of supporting parallel or lateral loads near the frame tip, and the structure close to the percussion region should be more rigid in the direction of hitting a ball. With a uniform frame as in a conventional racket, it is not possible to react to both kinds of external loads efficiently and effectively.

2. The drag coefficient of air for a rectangular cross section, such as in a conventional racket, is large, thus resulting in a great resistance against the movement of the racket.

3. The bending rigidity of a rectangular cross section is less than an elliptical one with the same material and same cross-sectional area, in accordance with the theory of the strength of material. The lower the bending rigidity, the larger the deflection. A large deflection results will apparently in less precise control of a ball's movement.

Accordingly, a racket with a uniform rectangular cross section is less efficient and effective in playing. Besides, a uniform rectangular cross section also results in greater stress in certain locations when acted upon by external loads.

OBJECT OF THE INVENTIONS

It is therefore an object of the present invention to provide a racket frame, the cross section of which is non-uniform and is constituted by triangles and ellipses so as to increase the strength of the racket and to more evenly distribute impact forces over the whole frame.

Accordingly, the present invention provides a tennis racket having a frame with a cross section constituted by a plurality of different shapes, including at least triangles and ellipses. The frame is constituted by three sections, of which the first is connected to the shaft of the racket via a base section and has an elliptical cross section so as to provide a more rigid percussion region and thus better control over tennis balls, the second is next to the tip of the frame and has a triangular cross section which is more capable of supporting top and lateral forces resulting from contacts with external objects, and the third is located in between and has an intermediate shape that changes gradually from the ellipse of the first section to the triangle of the second section so as to provide a connection and continuity between the first and second sections.

Other objects and advantages of the present invention will be apparent from the following description taken in conjunction with the accompanying drawings, wherein:

DETAILED DESCRIPTION OF THE PREFERRED EMBODIMENTS

Figure 16:
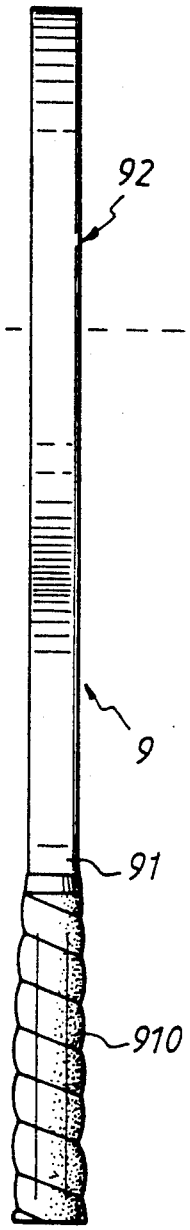
Fig. 16 PRIOR ART
FIG. 16 is a side view of a conventional tennis racket.
Figure 14:
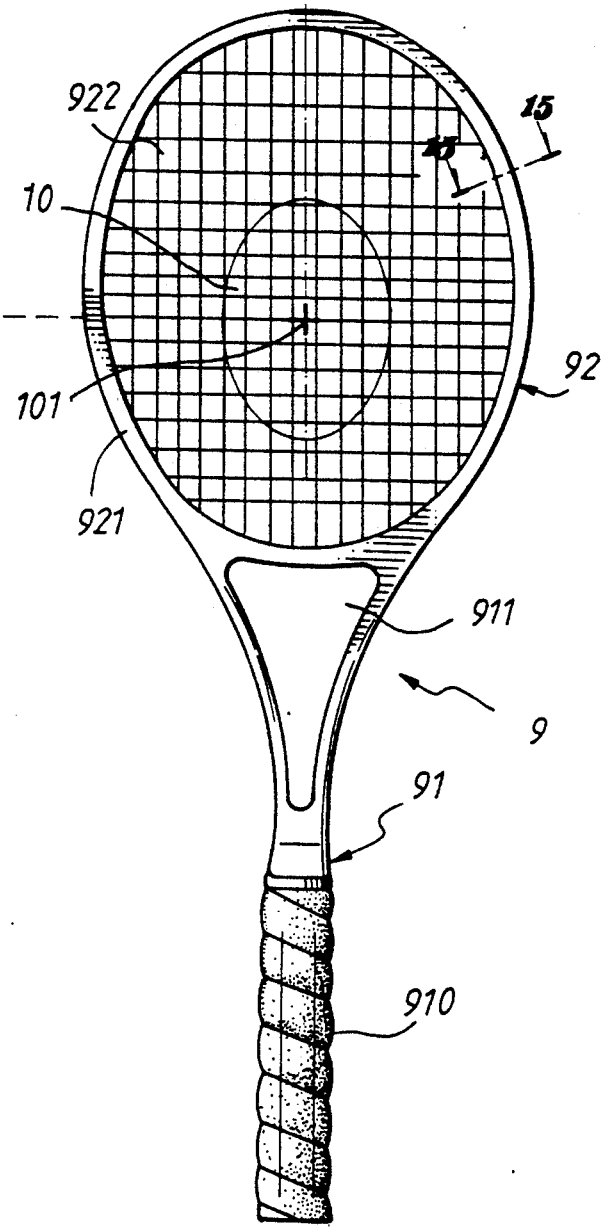
Fig. 14 PRIOR ART
FIG. 14 is a plane view of a conventional tennis racket.
Figure 15:
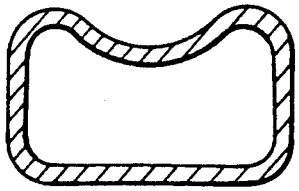
Fig. 15 PRIOR ART
FIG. 15 is an enlarged cross-sectional view taken along line 15—15 of FIG. 14.

Referring to the drawings, and in particular to FIGS. 14, 15 and 16, wherein a conventional racket 9, which has a uniform and substantially rectangular cross section as shown in FIG. 15, is constituted by a shaft 91 and a head 92. The shaft 91 is further constituted by a handle 910 and a throat 911. The head 911 is basically a frame 921 with a plurality of strings 922 stretched within and securely fixed on the frame 921. Inside the frame 921, a region where tennis balls are supposed to contact the strings 922 and be consequently hit is called percussion region 10 and has a center called percussion center 101 which is marked with a cross in FIG. 14. The percussion center 101 is the ideal location to impact a tennis ball.

Basically, a racket should possess the characteristic of high impact absorbability, good control over balls (which means the deflection of the racket should be small), large sweet spot, great rigidity in playing, strength, flexibility, etc. The traditional design, such as the rectangular cross section shown in FIG. 15, is not able to simultaneously meet all these requirements.

Figure 10:
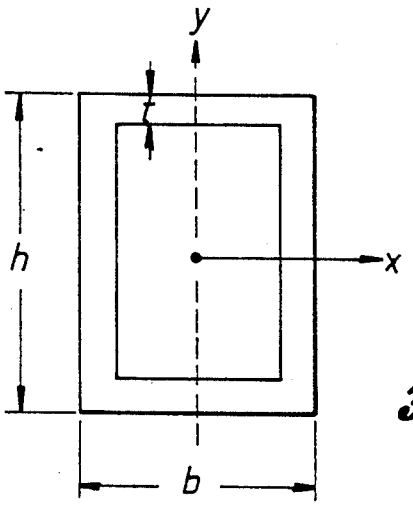
FIG. 10 is a hollow rectangle which is used as the cross section of a conventional racket frame.
Figure 11:
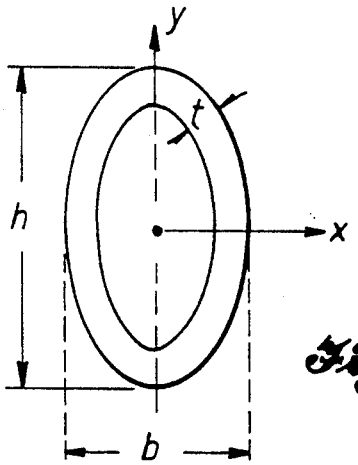
FIG. 11 is a hollow elliptical which is used as the cross section of the ellipse section of a racket in accordance with the present invention.
Figure 12:
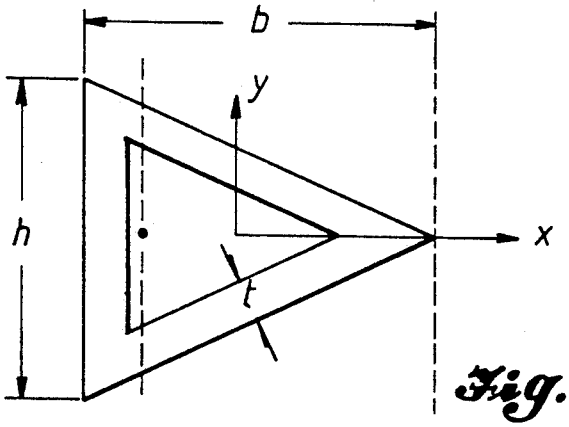
FIG. 12 is a hollow triangular which is used as the cross section of the triangle section of a racket in accordance with the present invention.
Figure 13:
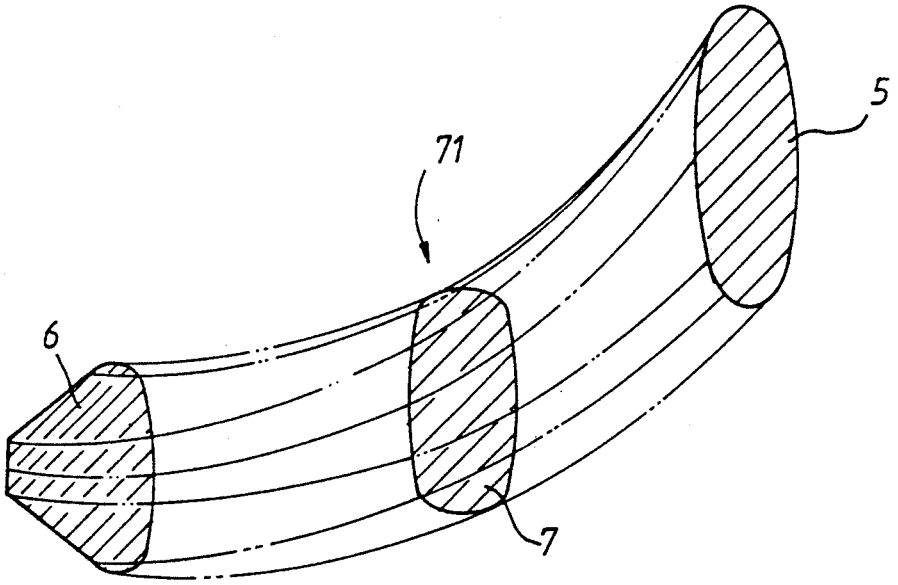
FIG. 13 is a perspective view of the intermediate section of the frame in accordance with the present invention, showing the gradual change of the cross-sectional shape.

It is well known that area moment of inertia of an object is dependent upon two factors: its shape and size. With the same cross sectional area (which implicitly implies the same size), different shapes still result in different area moment of inertia values. The following Table, in numerically comparing the configurations shown in FIGS. 10, 11 and 12, same as an example to demonstrate the effect of shape on area moment of inertia, and also reveal the improvement of area moment of inertial by using different cross sectional shapes.

| | Ht (h) | Wd (b) | Tk (t) | Area Moment Area of inertia in X-dir ($I_{xx}$) | | Area Moment of inertia in Y-dir ($I_{yy}$) |
|---|---|---|---|---|---|---|
| Hollow Rectangle | 20 mm | 11 mm | 2 mm | 108 mm$^2$ | 4944 mm$^4$ | 1761 mm$^4$ |
| Hollow Ellipse | 28 mm | 11 mm | 2 mm | 108 mm$^2$ | 7103 mm$^4$ | 1425 mm$^4$ |
| Hollow Triangle | 21 mm | 21 mm | 2 mm | 108 mm$^2$ | 2997 mm$^4$ | 3996 mm$^4$ |

It is found that in the case where every one has the same cross-sectional area of 108 mm$^2$, the ellipse has the largest Ixx and the smallest Iyy, the triangle has the smallest Ixx and the largest Iyy, and the rectangle has in-between values in for both Ixx and Iyy. By using ellipses and triangles as the cross-sectional shape, it is thus possible to increase the bending rigidity of a racket frame owing to the larger Ixx and Iyy that these configurations result in.

When a racket hits a tennis ball, an impact force will act upon the racket head in the direction normal to the plane of the racket head. In order to react to this impact without deflecting significantly, a cross section having great bending rigidity in the direction parallel to the impact acting direction should be adopted. Taking this direction as the X-direction, coinciding with the X-direction of FIGS. 10, 11 and 12, the ellipse is the best shape to take impact forces of this kind.

When a racket hits the ground with its tip (as happens very often in tennis), an impact force will act upon the frame of the racket in the plane of the racket head. Taking the direction which is in the plane of the racket head and normal to the frame as the Y-direction, coinciding with the Y-direction shown in FIG. 10, 11 and 12, the triangle is the best shape to take this load, because it has the largest Iyy.

By taking the above into account, it is therefore a basic principle of the present invention to adopt different configurations as the cross-sectional shapes at different locations so as to adjust and increase the bending rigidity of the frame in accordance with different types of external loads.

Referring now to FIGS. 1 to 6, wherein a racket 8 in accordance with the present invention is shown, the racket 8 has a shaft 81 and a head 82 securely fixed to the shaft 81. The shaft 81 is constituted by a handle 2 and a throat 3. The head 82 is basically a frame 1 with a stringing zone 4 therein. The stringing zone 4 comprises a percussion region 41 which is supposed to be the region where tennis balls (not shown) are hit and has a percussion center 42. The length of the frame 1 along the symmetric axis, which is the axis running through the center of the shaft 81 and the handle 2, is designated by "S".

Figure 7:
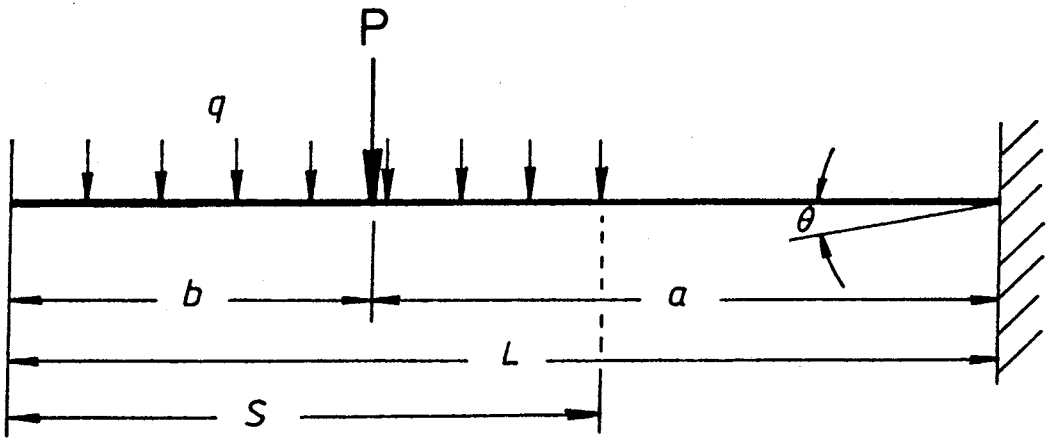
FIG. 7 is a cantilever beam model used to simulate a tennis racket during a hit by a tennis ball.
Figure 8:
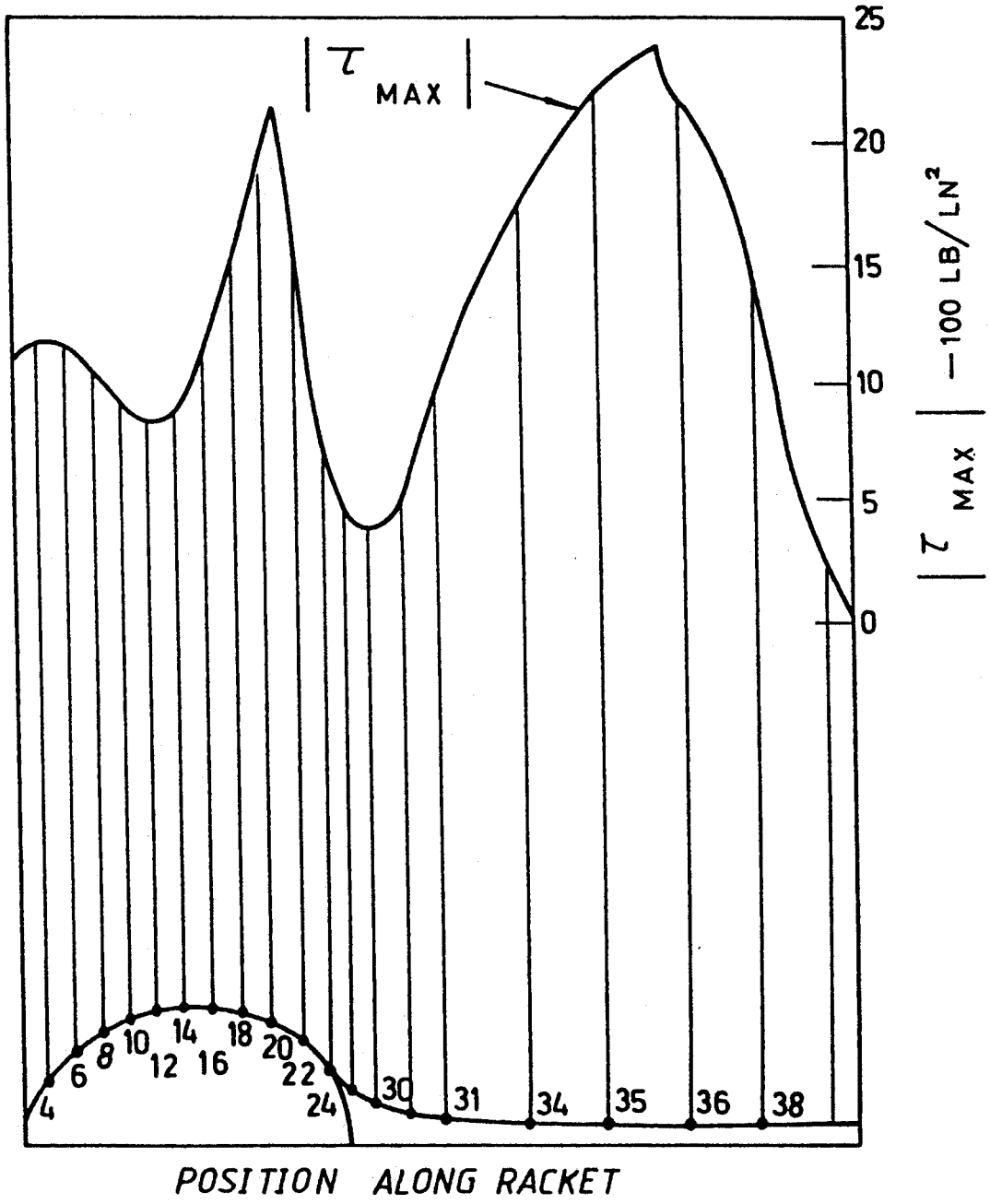
FIG. 8 is a plot of stress distribution along the length of a tennis racket when the racket is acted upon by a tennis ball at the racket head.

It is shown in FIG. 8 that when a racket is hitting a tennis ball, the highest stress within the frame is inside the region between locations 16 and 22. This is a region close to the throat of the racket. Further, if a racket is simulated with a cantilever beam acted upon by two loads q and p, as shown in FIG. 7, wherein q is a load distributed on the whole stringing Zone 4 and p is also a distributed load over a much smaller region, in general within the percussion region 10 and is regarded as a concentrated load acting upon the percussion center 42, "L" designates the total length of the racket, "a" is the distance between the end of the handle and the location where the impact force "P" is applied, and "b" is the remaining part of the racket, it is understood that only the portion "a" will be bent by the loads "P" and "q" while the portion "b" takes no load and remains straight.

Accordingly, the portion of the frame to the right of the percussion center 42 (in view of FIG. 1) should have an elliptical cross section so as to increase the resistance against the load "P", as the ellipse has the greatest Ixx. The length of the ellipse section 51 (FIG. 5) is about one-third of the length of the frame "S", and is to the right of the percussion center (in view of FIG. 1). The dimensions of the ellipse are preferably from 14 to 30 mm in the long axis direction, i.e. the X-direction, and from 10 to 12 mm in the short axis direction, i.e. the Y-direction. To connect the ellipse section 51 to the throat 3, a base section 31 is disposed therebetween. The base section 31 has a substantially rectangular cross section and the shape changes gradually to match the ellipse of the ellipse section 51.

Figure 6:
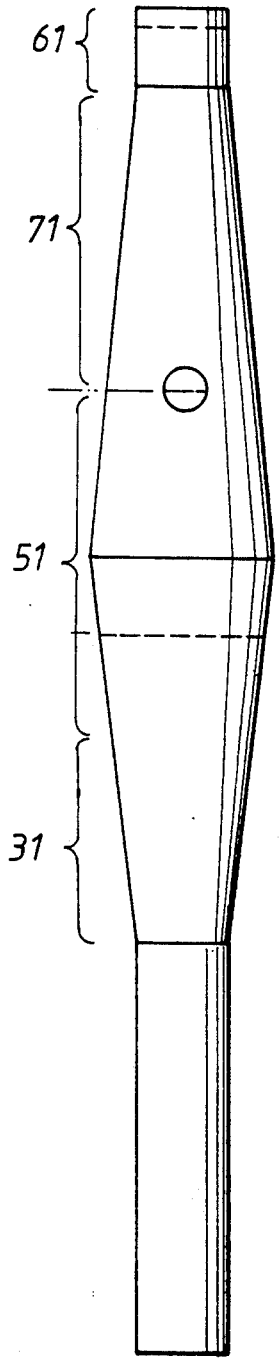
FIG. 6 is a side view of another embodiment of a tennis racket in accordance with the present invention.

Referring particularly to FIG. 6, wherein another embodiment of the present invention is shown, the ellipse section 51 may have a shape which changes gradually from the point of connection with the base section 31 to an elliptical shape described above and then changes gradually to match the other shape at the opposite end (which will be described later).

Figure 1:
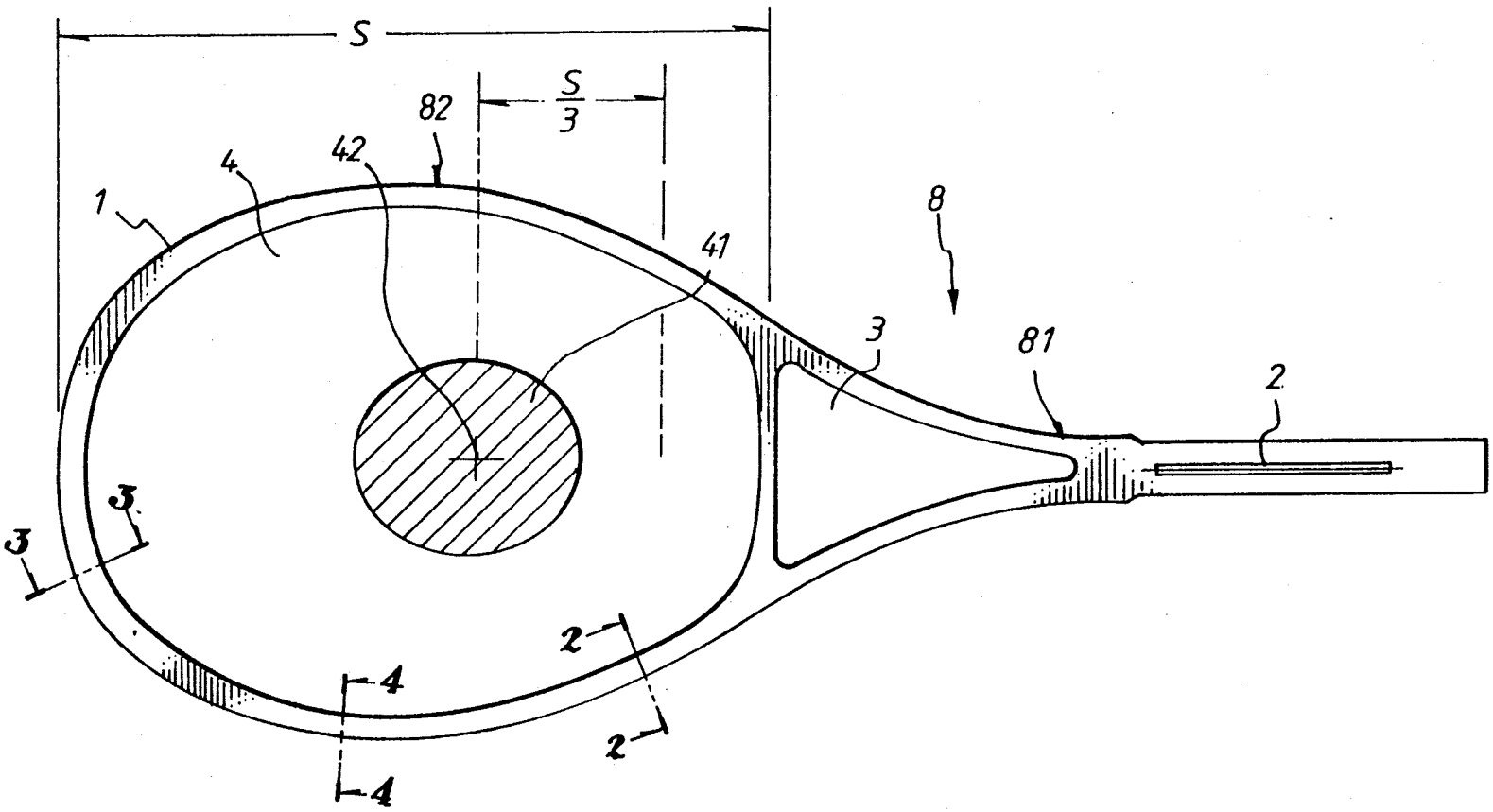
FIG. 1 is a plane view of a tennis racket in accordance with the present invention.
Figure 2:
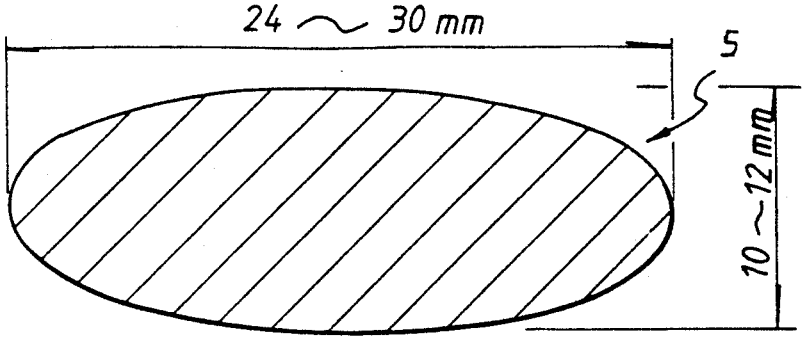
FIG. 2 is an enlarged cross-sectional view of the elliptical section of the frame taken along line 2—2 of FIG. 1.
Figure 3:
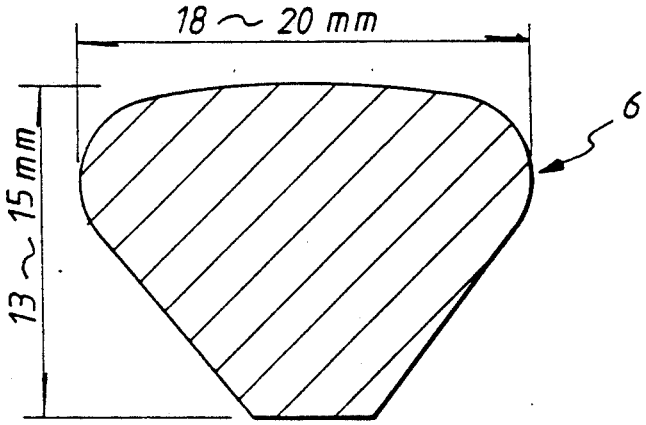
FIG. 3 is an enlarged cross-sectional view of the triangular section of the frame taken along line 3—3 of FIG. 1.
Figure 4:
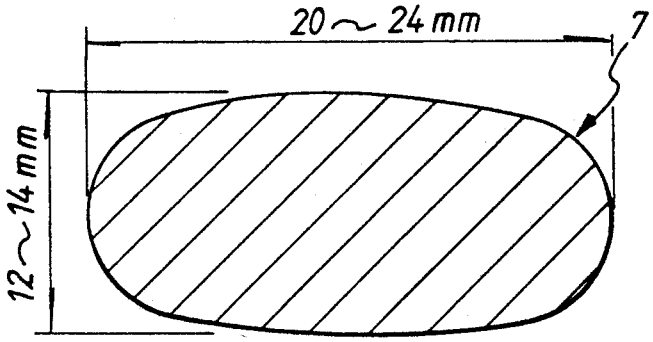
FIG. 4 is an enlarged cross-sectional view of the intermediate section of the frame taken along line 4—4 of FIG. 1.
Figure 5:
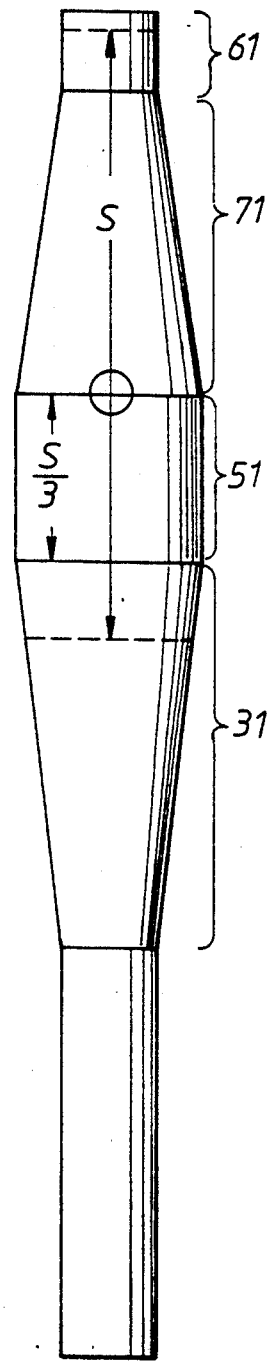
FIG. 5 is a side view of an embodiment of a tennis racket in accordance with the present invention.
Figure 9:
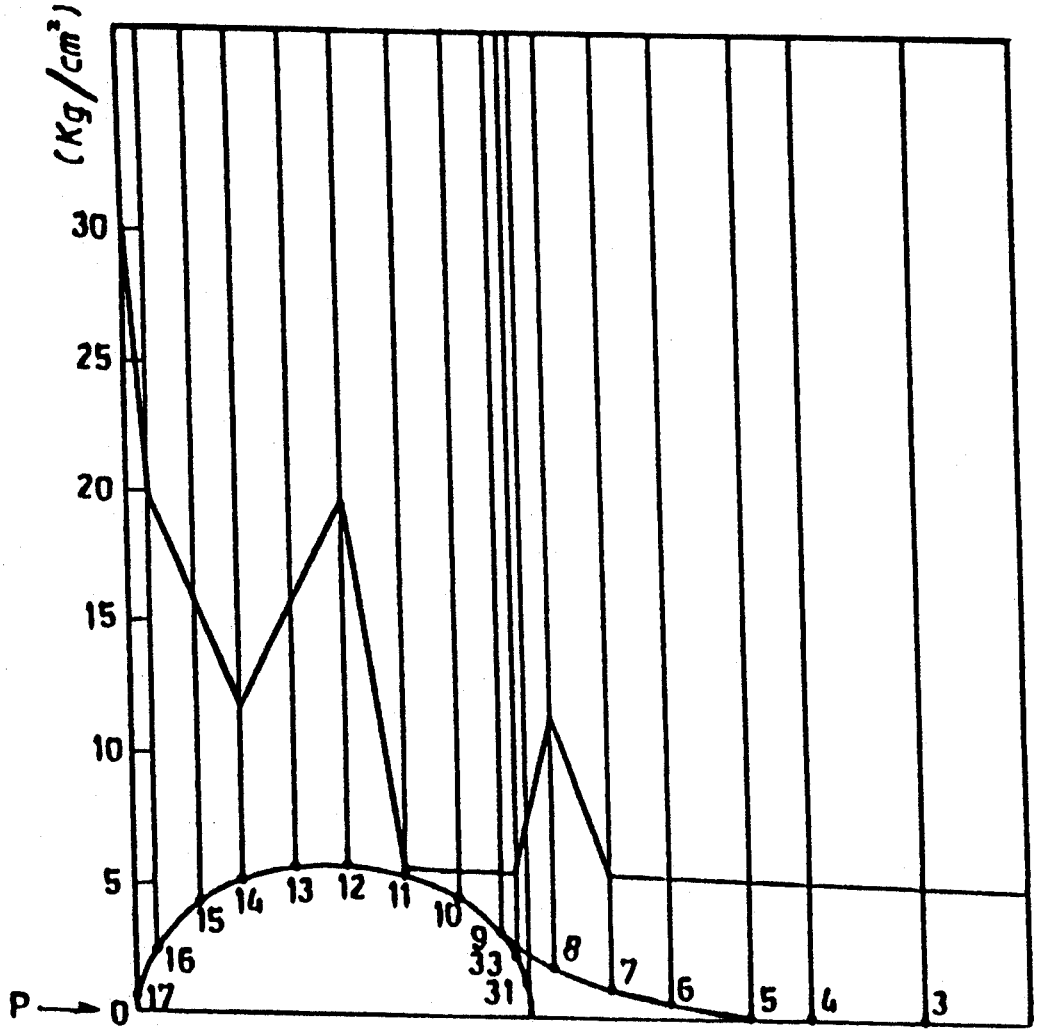
FIG. 9 is a plot of stress distribution along the length of a tennis racket when the racket is subjected to a top impact.

To deal with impact forces on the tip of the racket 8, a triangular cross section (FIG. 3) is adopted around the tip thereof. This is because the triangle has the largest Iyy and is thus capable of taking lateral loads due to either an impact with the ground or tension in the strings. It is shown in FIG. 9 that when the racket 1 hits the ground, the portion of the frame that takes the largest stress is located around the tip of the frame. This reveals that it is necessary to adopt the triangular cross section at this section. The length of this region, the triangular region 61 in FIGS. 1, 5 and 6, is approximately from 50 to 150 mm along the frame 1 and in symmetry with the racket axis of symmetry. The bottom of the triangle is preferably from 18 to 22 mm, while the height is preferably from 13 to 15 mm.

Referring now to FIGS. 1, 5, 6 and 13, an intermediate section 71 is disposed between the elliptical section 51 and the triangular section 61 to provide a connection between them. The intermediate section 71 has a cross-sectional shape that change gradually from the ellipse 5 of the elliptical section 51 to a substantially rectangular 7 and then to the triangle 6 of the triangular section 61 so as to provide continuity between them.

It is of course given that while the above has been given by way of illustrative examples of the present invention, all such and other modifications and variations thereto as would be apparent to those skilled in the related arts are deemed to fall within the broad scope and ambit of the present invention as is defined in the appended claims.

We claim:

1. A tennis racket comprising a shaft, which is constituted by a handle, a throat, and a head, and which has a frame with strings stretched therein and securely fixed thereon, wherein said frame is constituted by three sections, an elliptical section, a triangular section and an intermediate section which also serves as a connecting segment, said elliptical section having an elliptical cross section and being connected to said throat of said shaft via a base section, said triangular section having a triangular cross section and being located at the tip of said frame, and said intermediate section disposed between said elliptical and triangular section and having a cross-sectional shape that changes gradually from the ellipse of said ellipse section to the triangle of said triangular section to provide a smooth continuous connection between the two sections.

2. A tennis racket as claimed in claim 1, wherein said elliptical cross section is located at a distance of about one-third of the racket frame away from a percussion center biased toward the handle of the racket.

3. A tennis racket as claimed in claims 1 or 2, wherein the length of said triangular section along the frame is preferably from 50 to 150 mm.

4. A tennis racket as claimed in claims 1 or 3, wherein the bottom of the triangle of said triangular section is preferably from 18 to 20 mm while the height is preferably from 13 to 15 mm.

5. A tennis racket as claimed in claims 1 or 3, wherein the long axis of the ellipse of said elliptical section is preferably from 24 to 30 mm while the short axis is preferably from 10 to 12 mm.

* * * * *